US010683624B2

(12) United States Patent
Whiteley

(10) Patent No.: US 10,683,624 B2
(45) Date of Patent: Jun. 16, 2020

(54) BARRIER

(71) Applicant: OXFORD PLASTIC SYSTEMS LIMITED, Oxfordshire (GB)

(72) Inventor: Christopher James Whiteley, Buckinghamshire (GB)

(73) Assignee: Oxford Plastic Systems Limited, Oxfordshire (GB)

( * ) Notice: Subject to any disclaimer, the term of this patent is extended or adjusted under 35 U.S.C. 154(b) by 0 days.

(21) Appl. No.: 16/083,042

(22) PCT Filed: Feb. 23, 2017

(86) PCT No.: PCT/GB2017/050468
§ 371 (c)(1),
(2) Date: Sep. 7, 2018

(87) PCT Pub. No.: WO2017/153713
PCT Pub. Date: Sep. 14, 2017

(65) Prior Publication Data

US 2019/0093296 A1 Mar. 28, 2019

(30) Foreign Application Priority Data

Mar. 9, 2016 (GB) ..... 1604033.9

(51) Int. Cl.
*E01F 13/02* (2006.01)
*E04H 17/18* (2006.01)

(52) U.S. Cl.
CPC ..... *E01F 13/022* (2013.01); *E04H 17/18* (2013.01)

(58) Field of Classification Search
CPC ..... E01F 13/02; E01F 13/12; E01F 13/022; E04H 17/18
See application file for complete search history.

(56) References Cited

U.S. PATENT DOCUMENTS 1,071,283 A * 8/1913 Weaver ..... E04H 17/18 16/343
4,124,196 A 11/1978 Hipskind
4,854,767 A * 8/1989 Sasaki ..... E01F 8/0064 404/6
5,031,683 A * 7/1991 Marvy ..... A47G 5/00 160/351

(Continued)

FOREIGN PATENT DOCUMENTS

EP 1 647 634 A1 4/2006

OTHER PUBLICATIONS

Search Report in United Kingdom Patent Application GB1604033.9, dated Sep. 25, 2016.

(Continued)

*Primary Examiner* — Abigail A Risic
(74) *Attorney, Agent, or Firm* — Potter Anderson and Corroon LLP

(57) ABSTRACT

A barrier (10) is described that comprises a barrier panel (12) having a first side edge (16) and a second side edge (18), and including a pair of fixed feet (26), the barrier panel (12) defining a channel within which a reinforcing member (34) is received, the reinforcing member (34) being oriented so as to be upstanding, in use, and located intermediate the first and second side edges (16, 18), and an adjustable foot (36) carried at the lower end of the reinforcing member (34).

13 Claims, 2 Drawing Sheets

(56) References Cited

U.S. PATENT DOCUMENTS

| | | | | |
|---|---|---|---|---|
| 5,402,988 | A * | 4/1995 | Eisele | E01F 13/022 160/351 |
| 5,419,065 | A * | 5/1995 | Lin | B60Q 7/00 40/550 |
| 5,863,030 | A | 1/1999 | Kotler et al. | |
| 6,257,559 | B1 | 7/2001 | Mouri | |
| 6,305,672 | B1 * | 10/2001 | Case | A01K 3/00 256/65.01 |
| 6,406,002 | B1 | 6/2002 | Hardy, III | |
| 6,676,113 | B2 * | 1/2004 | Christensen | E01F 13/022 160/351 |
| 7,540,682 | B1 | 6/2009 | Christensen et al. | |
| 9,624,630 | B1 * | 4/2017 | Maus | E04H 17/16 |
| 2002/0014619 | A1 | 2/2002 | Christensen et al. | |
| 2007/0245972 | A1 * | 10/2007 | Symons | A63C 19/06 119/255 |
| 2013/0049992 | A1 * | 2/2013 | Mothaffar | E01F 13/022 340/908.1 |
| 2014/0145046 | A1 * | 5/2014 | Layne | E04H 12/2238 248/188.1 |
| 2015/0308058 | A1 | 10/2015 | Boyce | |
| 2018/0238002 | A1 * | 8/2018 | Wahlin | E04H 12/2284 |

OTHER PUBLICATIONS

International Search Report and Written Opinion in International Patent Application PCT/GB2017/050468, dated May 10, 2017.

* cited by examiner

BARRIER

This invention relates to a barrier for use in temporarily restricting access to, for example, open access chambers, trenches or cavities excavated into a road or footpath surface, communications cabinets or other areas in which work may be being undertaken where public access should desirably be restricted.

A number of barrier designs are known that are suitable for use in such applications. One known design of barrier comprises a series of panels connected in an end to end fashion, each panel including a pair of fixed feet. In use, stability is achieved by erecting the barrier in such a manner that the panels are angularly orientated relative to one another. Such a barrier is convenient in that it is typically of relatively small dimensions, being compact when stowed, and so transportation and storage thereof is relatively easy. However, it is not suitable for use in applications in which a relatively long, straight boundary edge is to be defined by the barrier, as the barrier when arranged in this manner is of poor stability.

Furthermore, should a passer-by attempt to lean on the barrier or rely upon the barrier for support, the barrier will tend to flex, providing little support.

It is an object of the invention to provide a barrier in which at least some of the disadvantages associated with known barriers are overcome or are of reduced effect.

According to the present invention there is provided a barrier comprising a barrier panel having a first side edge and a second side edge, and including a pair of fixed feet, the barrier panel defining a channel within which a reinforcing member is received, the reinforcing member being oriented so as to be upstanding, in use, and located intermediate the first and second side edges, and an adjustable foot carried at the lower end of the reinforcing member.

One or more additional, similar barriers may be attached to the barrier in an end-to-end fashion.

It will be appreciated that the invention is advantageous in that the adjustable foot may be moved to an in use position in which it extends substantially perpendicularly to a plane of the barrier panel, thereby providing stability to the barrier. It will further be appreciated that the adjustable feet allow the use of the invention in applications in which a plurality of barriers are connected to one another and arranged in a straight line. When not in use, the adjustable feet can adopt a stowed configuration in which they lie within the planes of the barrier panels, and so render the assembly convenient for transportation or storage.

The reinforcing member conveniently extends from the foot to a top rail of the barrier panel. Consequently, loadings applied to the top rail will be transmitted through the reinforcing member directly to the adjustable foot, providing the top rail with a greater degree of rigidity, and so assisting in ensuring that passers by relying upon the barrier for support are properly supported.

The barrier panel is conveniently of moulded plastics material form.

The reinforcing member preferably takes the form of a pultruded member, for example of plastics material form. By way of example, it may be of fibre reinforced plastics materials form. It is conveniently of circular cross-sectional shape, and the channel in which it is received is preferably similarly shaped.

The adjustable foot conveniently comprises a reinforced plastics material moulding. The adjustable foot may include a reinforcing bar arranged, in use, to extend generally horizontally, the reinforcing bar being secured at its mid-point to the lower end of the reinforcing member. The reinforcing bar may be of, for example, square cross-sectional shape.

The fixed feet are conveniently of generally square cross-sectional shape. Conveniently, the dimensions thereof are such that the fixed feet can be received within openings formed in an auxiliary foot block.

A latch member may be pivotally mounted upon the barrier panel and cooperable with an adjacent similar barrier panel to hold the barrier panels in a substantially straight line configuration, when desired.

Connector members may be provided to hingedly connect adjacent barrier panels to one another. The connector members preferably allow relative movement of the adjacent barrier panels between a position in which the barrier panels are arranged in a substantially straight line and a configuration in which they lie adjacent one another.

The invention will further be described, by way of example, with reference to the accompanying drawings, in which:

FIG. 1 is an exploded perspective view of a barrier in accordance with an embodiment of the invention in a stowed configuration;

FIG. 1*a* illustrates the barrier of FIG. 1 in an assembled condition;

Figure 1:
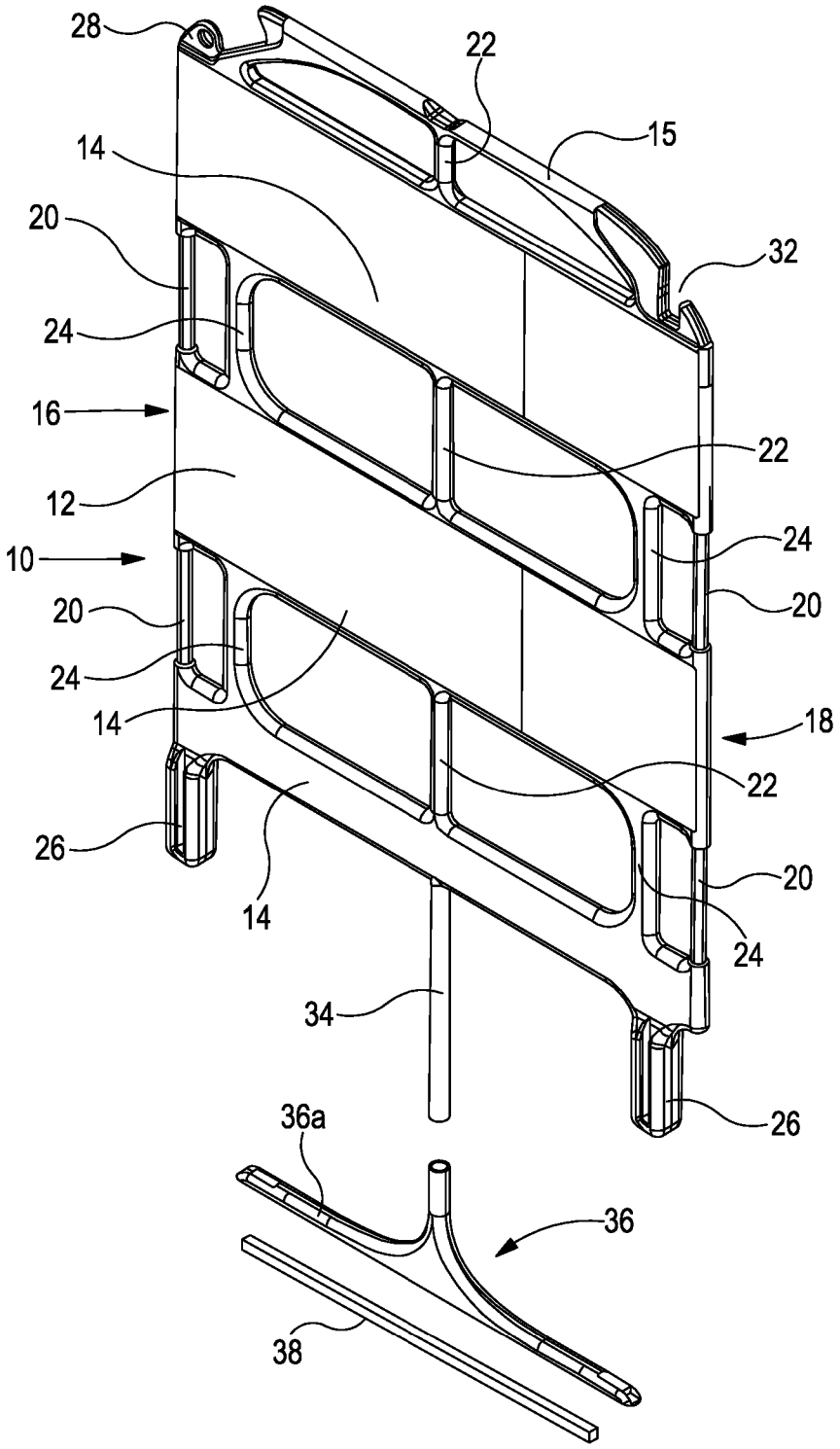
Figure 2:
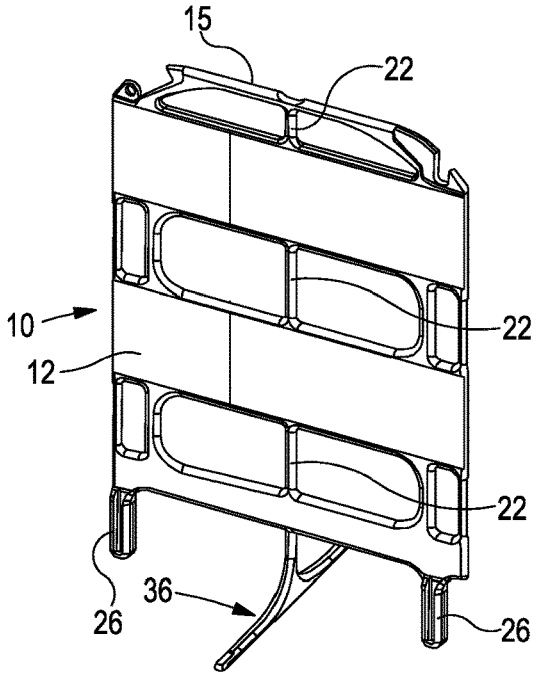
FIG. 2 is a view similar to FIG. 1 showing the barrier in an in-use configuration.
Figure 3:
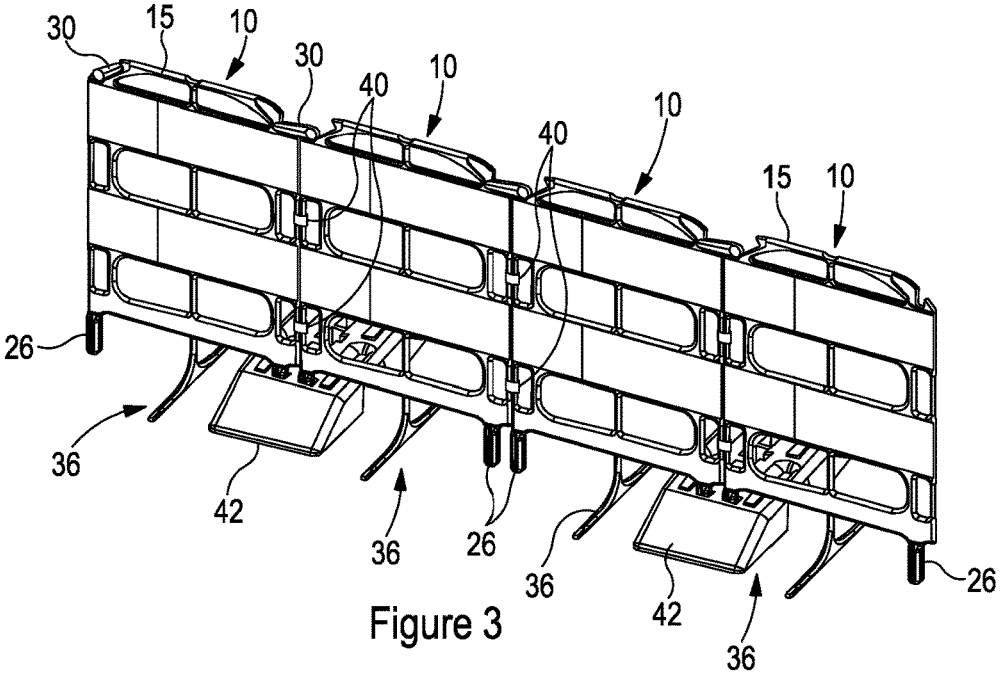
FIG. 3 illustrates a plurality of the barriers, in use.

Referring to FIGS. 1 to 3 of the accompanying drawings, a barrier 10 is shown which comprises a plastics moulded barrier panel 12. The panel 12 is of one piece form comprising three spaced rail sections 14 interconnected with one another. The rails 14 are interconnected at the edges 16, 18 of the panel 12 by connecting pillars 20. Furthermore, the rails 14 are interconnected intermediate the edges 16, 18 by connecting pillars 22. The pillars 22 are coaxially arranged and extend along a centre line of the panel 12 in this embodiment, but it will be appreciated that in some designs the pillars 22 may be offset slightly from the centreline, if desired.

In addition to being interconnected by the pillars 20, 22, the rails 14 are further interconnected by details 24.

Above, and connected to, the uppermost one of the rails 14 is formed a top rail 15. One of the connecting pillars 22 extends between the uppermost one of the rails 14 and the top rail 15.

To the bottom of the panel 12 is formed a pair of integral fixed feet 26. The fixed feet 26 are of substantially square cross sectional shape.

Adjacent one edge 16 of the top one of the rails 14 is provided a projection 28 formed with an opening within which a pivot pin of a latch member 30 (see FIG. 3) is located to pivotally mount the latch member 30 to the panel 12. Adjacent the other edge 18 of the top one of the rails 14 is formed a latch recess 32 with which a latch member 30 of another similar barrier 10 can cooperate.

The panel 12 is of moulded plastics material form, as mentioned above, and is at least in part of hollow construction. The pillars 22 are of hollow form and define a channel within which, as shown in FIG. 1, is received a reinforcing member 34 in the form of a plastics material, for example fibre reinforced plastics material, pultruded rod. The reinforcing member 34 may be of solid form or, alternatively, may be of hollow form. It is secured within channel defined by the hollow pillars 22 by means of a screw threaded fastener extending through an upper part of the panel 12 and into the upper end of the reinforcing member 34. The reinforcing member 34 is thus axially fixed within the panel 12, but is free to undergo rotation relative thereto. It provides additional reinforcement or strength to the central part of the panel 12.

The reinforcing member 34 extends to a position in which it engages part of the top rail 15, the interengagement between the top rail 15 and the reinforcing member 34 being such that loads applied to the top rail 15 are transmitted to the reinforcing member 34, being transmitted along the length of the reinforcing member 34.

An adjustable foot 36 is mounted upon the lower end of the reinforcing member 34. The foot 36 conveniently takes the form of a plastics moulded foot member 36*a* within which a reinforcing bar 38, conveniently of square cross-sectional shape is located. The bar 38 is located so as to engage the ground surface upon which the barrier is erected, in use. The lower end of the reinforcing member 34 is conveniently screwed, bolted or otherwise secured to the mid-point of the bar 38 to secure the adjustable foot 36 to the panel 12.

Figure 1A:
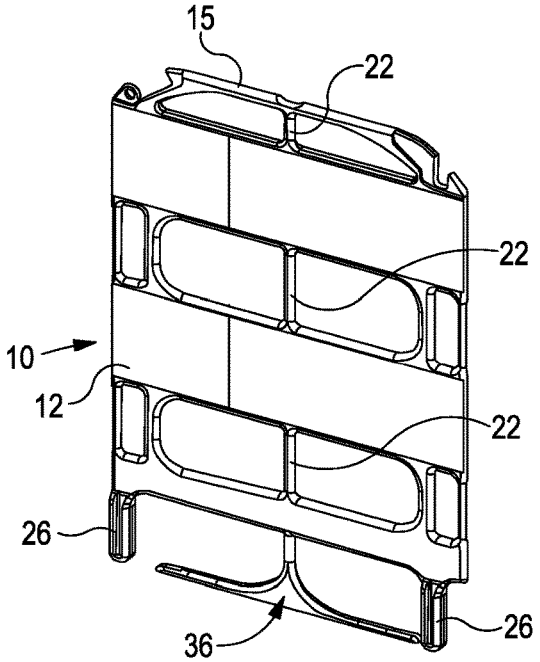

As illustrated in FIGS. 1*a* and 2, the adjustable foot 36 is movable between a stowed angular condition (see FIG. 1*a*) in which it lies in substantially the same plane as the panel 12, and an in-use angular position (see FIG. 2) in which the foot 36 is oriented such that its longitudinal axis is substantially perpendicular to the panel 12. Movement of the adjustable foot 36 between these positions is achieved simply by manipulation of the adjustable foot 36, the reinforcing member 34 undergoing corresponding angularly movement relative to the panel 12. With the adjustable foot 36 in the stowed position, it will be appreciated that the barrier 10 is of relatively compact form, lending itself to convenient storage and transportation. When it is to be used, the foot 36 is moved to the position shown in FIG. 2, whereon the barrier 10 is able to stand in a free standing, self-supporting, stable manner, the barrier 10 standing upon both the fixed feet 26 and the adjustable foot 36.

The invention thus provides a barrier 10 of enhanced stability and strength in a manner that is convenient to use and is convenient for storage and transportation. Should a passer-by place loadings upon the top rail 15, for example leaning upon it or relying upon it for support, such loadings are transmitted via the reinforcing member 34 to the adjustable foot 36 and to the ground surface. As a consequence, deflection of the top rail 34 is limited, and the user will have confidence that the barrier is able to safely bear the loads being applied thereto. The barrier thus has a sturdy feel, even though the barrier panel 12 itself may be relatively weak.

Figure 4:
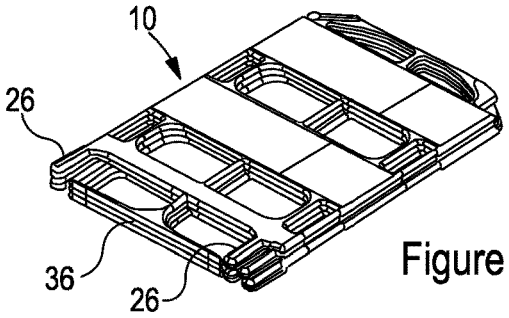
FIG. 4 illustrates the plurality of barriers in a stowed configuration.

As shown in FIG. 3, a plurality of the barriers 10 of FIGS. 1 to 3 may be connected to one another in an end-to-end fashion to form an elongate barrier assembly. In order to connect the barriers 10 to one another, connectors 40 are fitted to the pillars 20 of the respective panels 12. The connectors 40 conveniently take the form of plastics material mouldings defining a pair of parallel re-entrant channels into which respective ones of the pillars 20 can be fitted in a snap fit manner. The connectors 40 are able to pivot relative to the panels 12, the pivoting movement allowing the barriers 10 to adopt the substantially straight line configuration shown in FIG. 3, and allowing the barriers 10 to be moved from this configuration to the concertina folded configuration shown in FIG. 4, allowing the barriers 10 to be transported or stored in a space efficient manner. As shown, before being moved to the configuration shown in FIG. 4, the adjustable feet 36 are each moved to the respective stowed position.

With the barriers 10 in the straight line configuration shown in FIG. 3, the latch members 30 may each be manipulated so as to cooperate with the recesses 32 provided in the adjacent barriers 10 to hold the barriers 10 in the straight line configuration. Clearly, before being moved to the configuration shown in FIG. 4, not only are the feet 36 moved to the respective stowed positions, but also the latch members 30 must be disengaged from the adjacent barriers 10.

As shown in FIG. 3, when in the straight line configuration, in order to provide the barriers 10 with the required level of stability, the adjustable feet 36 are each moved to the respective in-use position. In addition, if desired, at least some of the fixed feet 26 may be inserted into the openings of suitable auxiliary foot blocks 42, for example of moulded plastics material form. Where an auxiliary foot block is provided, it not only provides additional stability but may also be used to apply additional ballast to the barrier assembly, increasing its ability to withstand, for example, wind gusts or other laterally applied loads.

Whilst only illustrated in a stowed configuration and in a straight line configuration, it will be appreciated that the barrier assembly may also be used in a wide range of other configurations, in some of which the relative orientations of the barriers 10 may be such that the assembly has sufficient stability without requiring movement of the adjustable feet to their in use positions.

The barrier 10 described hereinbefore is advantageous in that the adjustable foot 36 thereof provides additional stability, when required. In addition, the reinforcing member 34 increases the strength of a central part of the panel 12 and provides the load transmitting functionality between the top rail 15 and the adjustable foot 36 mentioned hereinbefore, resulting in the barrier being of relatively sturdy form even though the barrier panel 12 thereof may be relatively weak. If desired, as shown, the barrier may be used in conjunction with auxiliary foot blocks 42 or the like.

Whilst a specific embodiment of the invention is described, it will be appreciated that a wide range of modifications and alterations may be made thereto without departing from the scope of the invention as defined by the appended claims.

The invention claimed is:

1. A barrier comprising a barrier panel having a first side edge and a second side edge, and including a pair of fixed feet, the barrier panel defining a channel within which a reinforcing member is received, the reinforcing member increasing strength of a central part of the panel and being oriented so as to be upstanding, in use, and located intermediate the first and second side edges, and an adjustable foot carried at the lower end of the reinforcing member, whereby the barrier is of compact form for storage and transportation in an assembled condition;

wherein the barrier panel includes a top rail, and the reinforcing member extends between the top rail and the adjustable foot; and wherein the reinforcing member is adapted to transmit loads between the top rail and the adjustable foot.

2. A barrier according to claim 1, further comprising at least one additional, similar barrier attached to the barrier in an end-to-end fashion.

3. A barrier according to claim 1, wherein the barrier panel is of moulded plastics material form.

4. A barrier according to claim 1, wherein the reinforcing member takes the form of a pultruded member.

5. A barrier according to claim 1, wherein the reinforcing member is of circular cross-sectional shape.

6. A barrier according to claim 1, wherein the adjustable foot comprises a reinforced plastics material moulding.

7. A barrier according to claim 1, wherein the adjustable foot includes a reinforcing bar arranged, in use, to extend generally horizontally, the reinforcing bar being secured at its midpoint to the lower end of the reinforcing member.

8. A barrier according to claim 7, wherein the reinforcing bar is of square cross-sectional shape.

9. A barrier according to claim 1, wherein the fixed feet are of generally square cross-sectional shape.

10. A barrier according to claim 1, further comprising an auxiliary foot block receiving at least one of the fixed feet.

11. A barrier according to claim 1, wherein a latch member is pivotally mounted upon the barrier panel and cooperable with an adjacent similar barrier panel to hold the barrier panels in a substantially straight line configuration, when desired.

12. A barrier according to claim 1, further comprising connector members to hingedly connect adjacent barrier panels to one another.

13. A barrier according to claim 12, wherein the connector members allow relative movement of the adjacent barrier panels between a position in which the barrier panels are arranged in a substantially straight line and a configuration in which they lie adjacent one another.

* * * * *